US006317099B1

(12) United States Patent
Zimmerman et al.

(10) Patent No.: US 6,317,099 B1
(45) Date of Patent: Nov. 13, 2001

(54) FOLDED DIPOLE ANTENNA

(75) Inventors: Martin L. Zimmerman, Chicago; John S. Wilson, Downers Grove, both of IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/479,489

(22) Filed: Jan. 10, 2000

(51) Int. Cl.[7] ..... H01Q 9/26
(52) U.S. Cl. ..... 343/803; 343/747
(58) Field of Search ..... 343/700 MS, 803, 343/747, 797, 795

(56) References Cited

U.S. PATENT DOCUMENTS

| | | | | |
|---|---|---|---|---|
| H001460 | | 7/1995 | Davis | 343/700 MS |
| 2,130,033 | | 9/1938 | Scharlau | 250/33 |
| 2,455,403 | * | 12/1948 | Brown | 250/33.65 |
| 2,465,673 | * | 3/1949 | Breen et al. | 343/803 |
| 2,750,589 | | 6/1956 | Harris | 343/821 |
| 2,785,399 | | 3/1957 | Harris | 343/796 |
| 3,196,443 | | 7/1965 | Martin | 343/797 |
| 3,482,253 | | 12/1969 | Zucconi | 343/834 |
| 3,496,570 | | 2/1970 | Lewis | 343/754 |
| 3,680,139 | | 7/1972 | Reynolds, Jr. | 343/756 |
| 3,680,143 | | 7/1972 | Ajioka et al. | 343/840 |
| 3,681,769 | | 8/1972 | Perrotti et al. | 343/84 |
| 3,681,771 | | 8/1972 | Lewis et al. | 343/753 |
| 3,718,935 | | 2/1973 | Ranghelli et al. | 343/797 |
| 3,720,953 | | 3/1973 | Ajioka | 343/771 |
| 3,740,754 | | 6/1973 | Epis | 343/797 |
| 3,742,506 | | 6/1973 | Wilkinson | 343/176 |

(List continued on next page.)

FOREIGN PATENT DOCUMENTS

| | | |
|---|---|---|
| 922 8386 | 5/1993 | (AU) . |
| 952 7118 | 2/1996 | (AU) . |
| 0 416 300 | 3/1991 | (EP) . |
| 0 464 255 | 1/1992 | (EP) . |
| 0 523 770 | 1/1993 | (EP) . |
| 0 566 522 | 10/1993 | (EP) . |
| 0 647 977 | 4/1995 | (EP) . |
| 0 657 956 | 6/1995 | (EP) . |
| 0 495 507 | 11/1995 | (EP) . |
| 0 715 477 | 6/1996 | (EP) . |
| 0 725 498 | 8/1996 | (EP) . |
| 0 433 255 | 1/1997 | (EP) . |
| 1236535 | 6/1959 | (FR) . |

OTHER PUBLICATIONS

"Planar Integrated Antenna Technology", *Microwave Journal*, Jul. 1999, pp 128–144 (article appears on even numbered pages only).

Brian Edward and Daniel Rees, "A Broadband Printed Dipole With Integrated Balun" Microwave Journal May 1987 (pp. 339–344).

Willmar K. Roberts, "A New Wide–Band Balun" IRE, Jun. 1957 (pp. 1628–1631).

*Primary Examiner*—Don Wong
*Assistant Examiner*—James Clinger
(74) *Attorney, Agent, or Firm*—Jenkens & Gilchrist; Stephen G. Rudisill

(57) ABSTRACT

A folded dipole antenna for transmitting and receiving electromagnetic signals is provided. The antenna includes a ground plane and a conductor extending adjacent the ground plane and spaced therefrom by a first dielectric. The conductor includes an open-ended transmission line stub, a radiator input section, at least one radiating section integrally formed with the radiator input section, and a feed section. The radiating section includes first and second ends, a fed dipole and a passive dipole. The fed dipole is connected to the radiator input section. The passive dipole is disposed in spaced relation to the fed dipole to form a gap. The passive dipole is shorted to the fed dipole at the first and second ends.

49 Claims, 12 Drawing Sheets

U.S. PATENT DOCUMENTS

| | | | | |
|---|---|---|---|---|
| 3,747,114 | | 7/1973 | Shyhalla | 343/795 |
| 3,750,185 | | 7/1973 | Evans | 343/814 |
| 3,757,342 | | 9/1973 | Jasik et al. | 343/738 |
| 3,810,185 | | 5/1974 | Wilkinson | 343/756 |
| 3,813,674 | | 5/1974 | Sidford | 343/730 |
| 3,821,742 | | 6/1974 | Pollard | 343/727 |
| 3,922,680 | | 11/1975 | Alsberg et al. | 343/754 |
| 4,015,263 | | 3/1977 | Koerner et al. | 343/708 |
| 4,015,265 | | 3/1977 | Dubost et al. | 343/747 |
| 4,031,537 | | 6/1977 | Alford | 343/704 |
| 4,087,818 | | 5/1978 | Kreutel, Jr. | 343/176 |
| 4,180,817 | | 12/1979 | Sanford | 343/700 MS |
| 4,193,077 | | 3/1980 | Greenberg et al. | 343/747 |
| 4,223,317 | | 9/1980 | Rod | 343/803 |
| 4,263,598 | | 4/1981 | Bellee et al. | 343/700 MS |
| 4,287,518 | | 9/1981 | Ellis, Jr. | 343/700 MS |
| 4,340,891 | | 7/1982 | Phillips | 343/713 |
| 4,364,050 | | 12/1982 | Lopez | 343/700 MS |
| 4,412,222 | | 10/1983 | Mohring et al. | 343/779 |
| 4,446,465 | | 5/1984 | Donovan | 343/797 |
| 4,464,663 | | 8/1984 | Lalezari et al. | 343/700 MS |
| 4,472,717 | | 9/1984 | Eaves et al. | 343/761 |
| 4,498,085 | | 2/1985 | Schwarzmann | 343/795 |
| 4,504,836 | | 3/1985 | Seavey | 343/761 |
| 4,518,969 | | 5/1985 | Bogner | 343/819 |
| 4,571,591 | | 2/1986 | Valentino et al. | 343/754 |
| 4,644,562 | | 2/1987 | Kavehrad et al. | 375/14 |
| 4,658,262 | | 4/1987 | DuHamel | 343/792.5 |
| 4,675,685 | | 6/1987 | Finken | 343/708 |
| 4,686,536 | * | 8/1987 | Allcock | 343/700 MS |
| 4,695,844 | | 9/1987 | Houchangnia | 343/781 CA |
| 4,710,775 | | 12/1987 | Coe | 343/727 |
| 4,737,793 | | 4/1988 | Munson et al. | 342/361 |
| 4,772,891 | | 9/1988 | Svy | 343/707 |
| 4,821,039 | | 4/1989 | Crane | 342/153 |
| 4,825,220 | | 4/1989 | Edward et al. | 343/795 |
| 4,839,663 | | 6/1989 | Kurtz | 343/771 |
| 4,870,426 | | 9/1989 | Lamberty et al. | 343/727 |
| 4,929,961 | | 5/1990 | Nakase | 343/715 |
| 4,943,811 | | 7/1990 | Alden et al. | 343/814 |
| 5,146,234 | | 9/1992 | Lalezari | 343/895 |
| 5,157,409 | | 10/1992 | Hamin | 343/715 |
| 5,172,080 | | 12/1992 | Fisher et al. | 333/1.1 |
| 5,206,655 | | 4/1993 | Caille et al. | 343/700 MS |
| 5,220,330 | | 6/1993 | Salvail et al. | 342/62 |
| 5,227,807 | | 7/1993 | Bohlman et al. | 343/895 |
| 5,268,701 | | 12/1993 | Smith | 343/767 |
| 5,274,391 | | 12/1993 | Connolly | 343/820 |
| 5,309,165 | | 5/1994 | Segal et al. | 343/770 |
| 5,319,379 | | 6/1994 | Waken et al. | 343/756 |
| 5,321,414 | | 6/1994 | Alden et al. | 343/816 |
| 5,400,042 | | 3/1995 | Tulinsteff | 343/727 |
| 5,451,969 | | 9/1995 | Toth et al. | 343/781 CA |
| 5,453,751 | | 9/1995 | Tsukamoto et al. | 343/700 MS |
| 5,481,272 | | 1/1996 | Yarsunas | 343/797 |
| 5,495,260 | * | 2/1996 | Couture | 343/795 |
| 5,499,033 | | 3/1996 | Smith | 343/700 MS |
| 5,534,877 | | 7/1996 | Sorbello et al. | 343/700 MS |
| 5,539,414 | | 7/1996 | Keen | 343/700 |
| 5,589,843 | | 12/1996 | Meredith et al. | 343/820 |
| 5,629,713 | | 5/1997 | Mailandt et al. | 343/808 |
| 5,630,226 | | 5/1997 | Kanda et al. | 455/313 |
| 5,742,258 | | 4/1998 | Kumpfbeck et al. | 343/795 |
| 5,818,397 | | 10/1998 | Yarsunas et al. | 343/797 |
| 5,917,456 | | 6/1999 | Teunisse | 343/795 |
| 5,936,590 | | 8/1999 | Funder | 343/795 |
| 6,034,649 | | 3/2000 | Wilson et al. | 343/795 |

* cited by examiner

FOLDED DIPOLE ANTENNA

CROSS-REFERENCE TO RELATED APPLICATIONS

This application claims the benefit of copending patent application Ser. Nos. 09/432,524 filed Nov. 3, 1999.

FIELD OF THE INVENTION

The present invention relates generally to antennas. More particularly, it concerns a folded dipole antenna for use in wireless telecommunications systems.

BACKGROUND OF THE INVENTION

Base station antennas used in wireless telecommunication systems have the capability to transmit and receive electromagnetic signals. Received signals are processed by a receiver at the base station and fed into a communications network. Transmitted signals are transmitted at different frequencies than the received signals.

Due to the increasing number of base station antennas, manufacturers are attempting to minimize the size of each antenna and reduce manufacturing costs. Moreover, the visual impact of base station antenna towers on communities has become a societal concern. Thus, it is desirable to reduce the size of these towers and thereby lessen the visual impact of the towers on the community. The size of the towers can be reduced by using smaller base station antennas.

There is also a need for an antenna with wide impedance bandwidth which displays a stable far-field pattern across that bandwidth. There is also a need for increasing the bandwidth of existing single-polarization antennas so they can operate in the cellular, Global System for Mobile (GSM), Personal Communication System (PCS), Personal Communication Network (PCN), and Universal Mobile Telecommunications System (UMTS) frequency bands.

The present invention addresses the problems associated with prior antennas by providing a novel folded dipole antenna including a conductor forming one or more integral radiating sections. This design exhibits wide impedance bandwidth, is inexpensive to manufacture, and can be incorporated into existing single-polarization antenna designs.

SUMMARY OF THE INVENTION

A folded dipole antenna for transmitting and receiving electromagnetic signals is provided. The antenna includes a ground plane and a conductor extending adjacent the ground plane and spaced therefrom by a first dielectric. The conductor includes an open-ended transmission line stub, a radiator input section at least one radiating section integrally formed with the radiator input section and a feed section. The radiating section includes first and second ends, a fed dipole and a passive dipole. The fed dipole is connected to the radiator input section. The passive dipole is disposed in spaced relation to the fed dipole to form a gap. The passive dipole is shorted to the fed dipole at the first and second ends.

BRIEF DESCRIPTION OF THE DRAWINGS

Other objects and advantages of the invention will become apparent upon reading the following detailed description and upon reference to the accompanying drawings, in which.

Figure 1A:
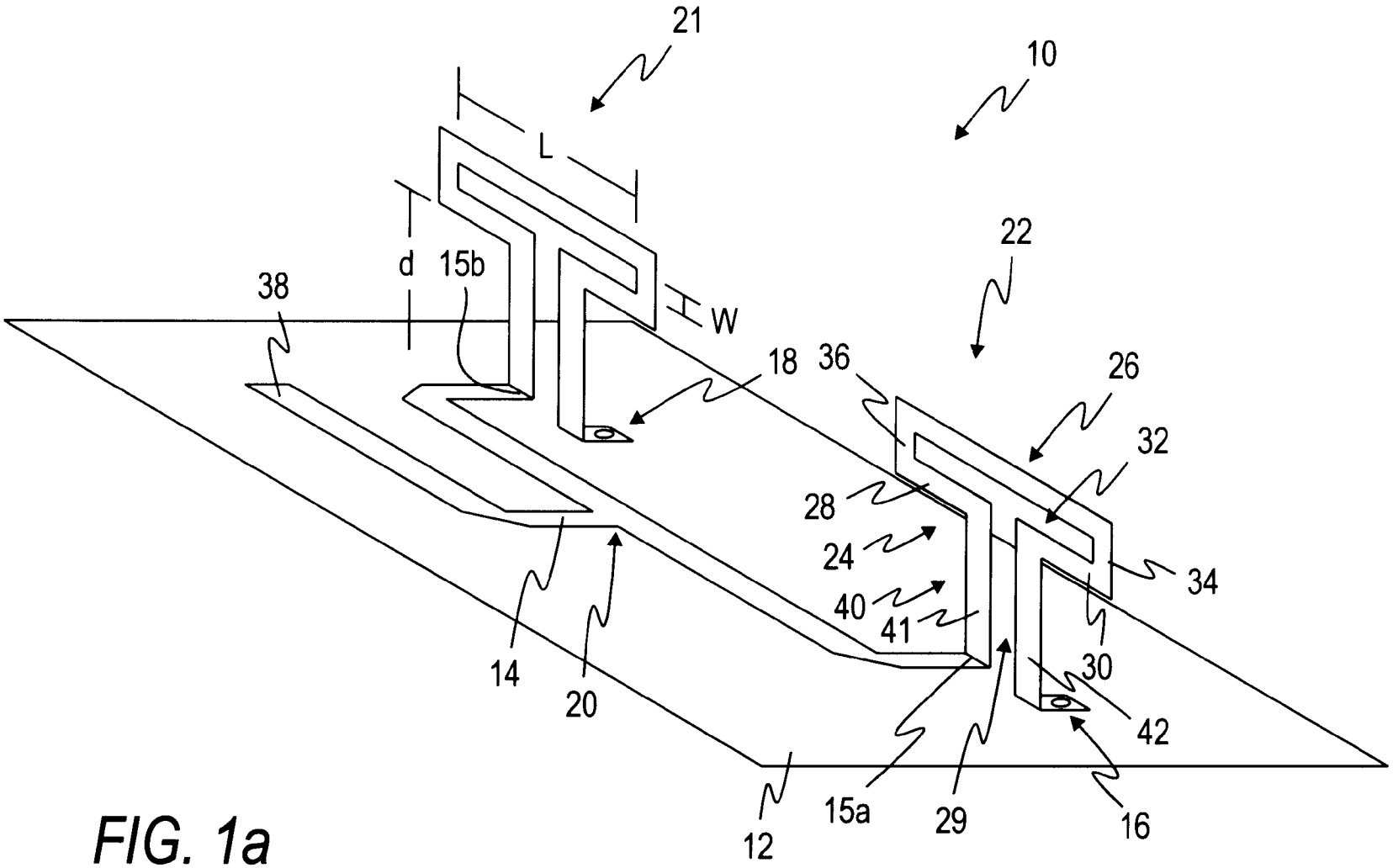
FIG. 1*a* is an isometric view of a folded dipole antenna according to one embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

The present invention is useful in wireless, broadcast, military and other such communication systems. One embodiment of the present invention operates across various frequency bands, such as the North American Cellular band of frequencies of 824–896 MHz, the North American Trunking System band of frequencies of 806–869 MHz, the Global System for Mobile (GSM) band of frequencies of 870–960 MHz. Another embodiment of the invention operates across several different wireless bands such as the Personal Communication System (PCS) band of frequencies of 1850–1990 MHz, the Personal Communication Network (PCN) band of frequencies of 1710–1880 MHz, and the Universal Mobile Telecommunications System (UMTS) band of frequencies of 1885–2170 MHz. In this embodiment, wireless telephone users transmit electromagnetic signals to a base station tower that includes a plurality of antennas which receive the signals transmitted by the wireless telephone users. Although useful in base stations, the present invention can also be used in all types of telecommunications systems.

The antenna illustrated in FIGS. 1*a*–4*b* is a folded dipole antenna 10 for transmitting and receiving electromagnetic signals. The antenna 10 includes a ground plane 12 and a conductor 14 formed from a single sheet of conductive material. The conductor 14 consists of three sections, a feed section 20, a radiator input section 40, and a radiating portion including radiating sections 21 and/or 22. The feed section 20 extends adjacent the ground plane 12 and is spaced therefrom by a dielectric, such as air, foam, etc., as shown in FIG. 1*b*. The radiating sections 21 and 22 are spaced from the surface or edge of the ground plane 12 in order to provide an antenna capable of wide bandwidth operation that still has a compact size.

A radiator input section 40 consists of two conductor sections 41 and 42 separated by a gap 29. The conductor section 41 connects one part of the radiating section 22 to the feed line 20, and the conductor section 42 connects another part of the radiating section 22 to the ground plane 12. The radiator input section 40 has an intrinsic impedance that is adjusted to match the radiating section 22 to the feed section 20. This impedance is adjusted by varying the width of the conductor sections 41, 42 and the gap 29.

Figure 1B:
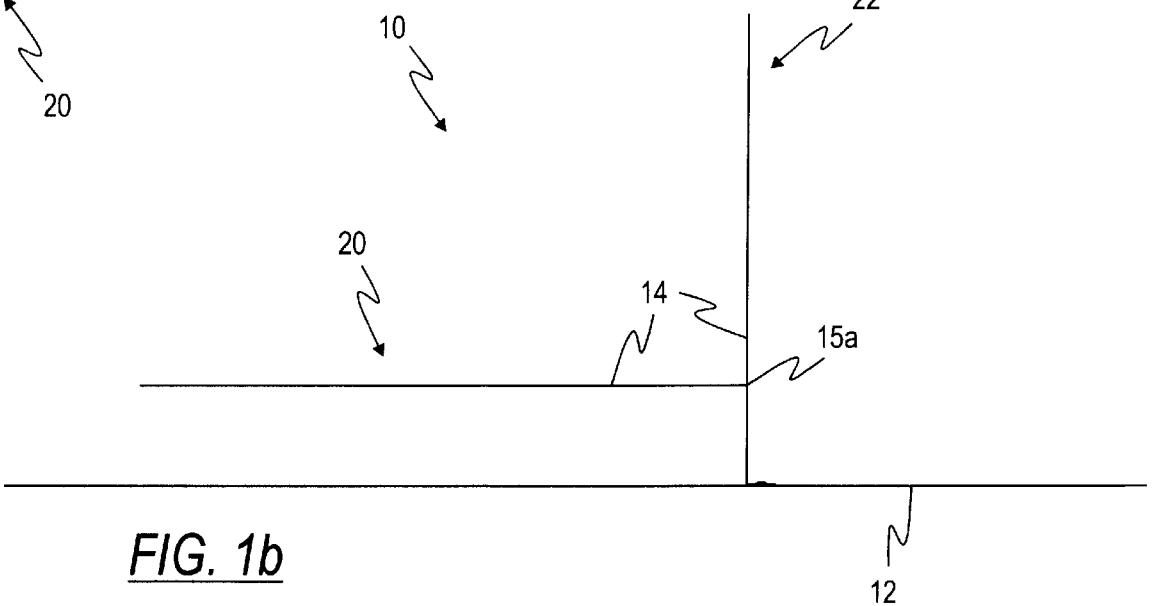
FIG. 1*b* is a side view of the folded dipole antenna of FIG. 1*a;*

In the illustrated embodiments of FIGS. 1*a–e*, the antenna 10 includes two radiating sections 21 and 22. In the embodiments of FIGS. 1*a*–1*b*, the conductor 14 is mechanically and electrically connected to the ground plane 12 at two locations 16 and 18. The radiating sections 21, 22 are supported at a distance d above the ground plane 12. In the wireless frequency band (1710–2170 MHz) embodiment, the distance d=1.22". The conductor 14 is bent at bends 15*a* and 15*b* such that the feed section 20 is supported by and displaced from the ground plane 12, as illustrated schematically in FIG. 1*b*. As a result, the feed section 20 is generally parallel to the ground plane 12. The feed section 20 includes an RI input section 38 that is adapted to electrically connect to a transmission line. The transmission line is generally electrically connected to an RF device such as a transmitter or a receiver. In one embodiment, the RF input section 38 directly connects to the RF device. The two illustrated radiating sections 21, 22 are identical in construction, and thus only the radiating section 22 will be described in detail. Radiating section 22 includes a fed dipole 24 and a passive dipole 26. The fed dipole 24 comprises a first quarter-wavelength monopole 28 and a second quarter-wavelength monopole 30. In one embodiment, the first quarter-wavelength monopole 28 is connected to one end of the conductor section 41. The other end of the conductor section 41 is connected to the feed section 20. The second quarter-wavelength monopole 30 is connected to one end of the conductor section 42, and the other end of conductor section 42 is connected to the ground plane 12 at location 16.

In this embodiment, the conductor section 42 can be connected to the ground plane 12 by any suitable fastening device such as a nut and bolt, a screw, a rivet, or any suitable fastening method including soldering, welding, brazing, and cold forming. A suitable connection provides both electrical and mechanical connections between the conductor 14 and the ground plane 12. Thus, the antenna 10 is protected from overvoltage and overcurrent conditions caused by transients such as lightning. One method of forming a good electrical and mechanical connection is the cold forming process available from Tox Pressotechnik GmbH of Weingarten, Germany (hereinafter "the cold forming process"). The cold forming process deforms and compresses one metal surface into another metal surface to form a Tox button. The cold forming process uses pressure to lock the two metal surfaces together. This process eliminates the need for separate mechanical fasteners to secure two metal surfaces together. Thus, in the embodiment where the radiating sections 21, 22 are attached to ground plane 12 by the cold forming process, the resulting Tox buttons at locations 16 and 18 provide structural support to the radiating sections 21, 22 and provide an electrical connection to the ground plane 12. Attaching the conductor 14 to the ground plane 12 by the cold forming process minimizes the intermodulation distortion (IMD) of the antenna 10. Certain other types of electrical connections such as welding will also minimize the IMD of the antenna 10.

The gap 32 forms a first half-wavelength dipole (passive dipole 26) on one side of the gap 32 and a second half-wavelength dipole (fed dipole 24) on the other side of the gap 32. The centrally-located gap 29 separates the fed dipole 24 into the first quarter-wavelength monopole 28 and the second quarter-wavelength monopole 30. Portions of the conductor 14 at opposing ends 34 and 36 of the gap 32 electrically connect the fed dipole 24 with the passive dipole 26. The gap 29 causes the conductor sections 41 and 42 to form an edge-coupled stripline transmission line. Since this transmission line is balanced, it efficiently transfers EM power from the feed section 20 to the radiating section 22. In the FIG. 1*a* embodiment, the ground plane 12 and the feed section 20 are generally orthogonal to the radiating sections 21, 22.

Figure 1C:
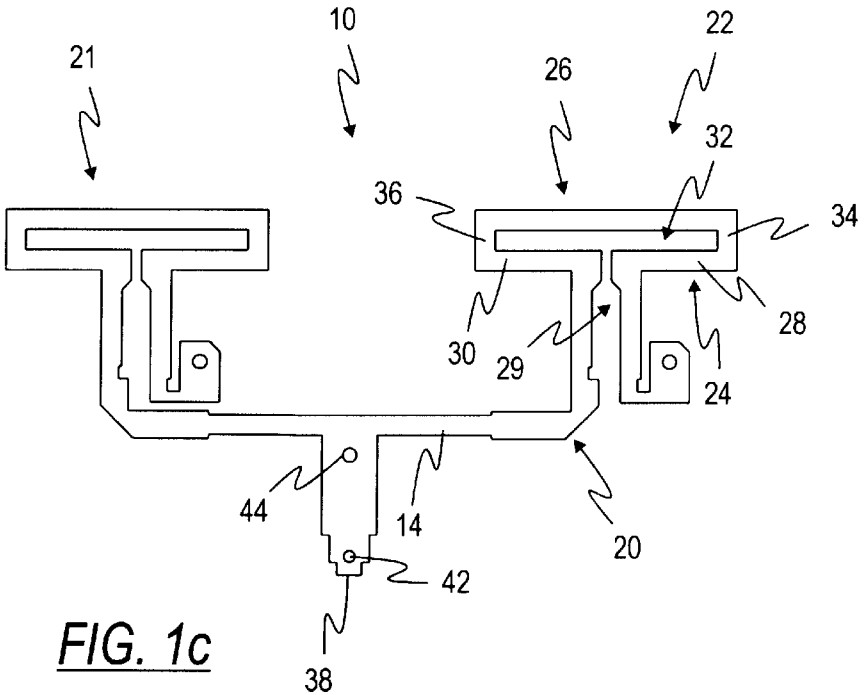
FIG. 1*c* is a top view of a conductor before it is bent into the folded dipole antenna of FIG. 1*a;*

Referring to FIG. 1*c*, there is shown a top view of a conductor 14 before it is bent into a folded dipole antenna similar to the antenna shown in FIG. 1*a*. A hole 42 is provided in the RF input section 38 to aid in connecting the RF input section 38 to a conductor of a transmission line or RF device. One or more holes 44 are provided to facilitate attachment of one or more dielectric supports between the feed section 20 and the ground plane 12. The dielectric supports may include spacers, nuts and bolts with dielectric washers, screws with dielectric washers, etc.

Figure 1D:
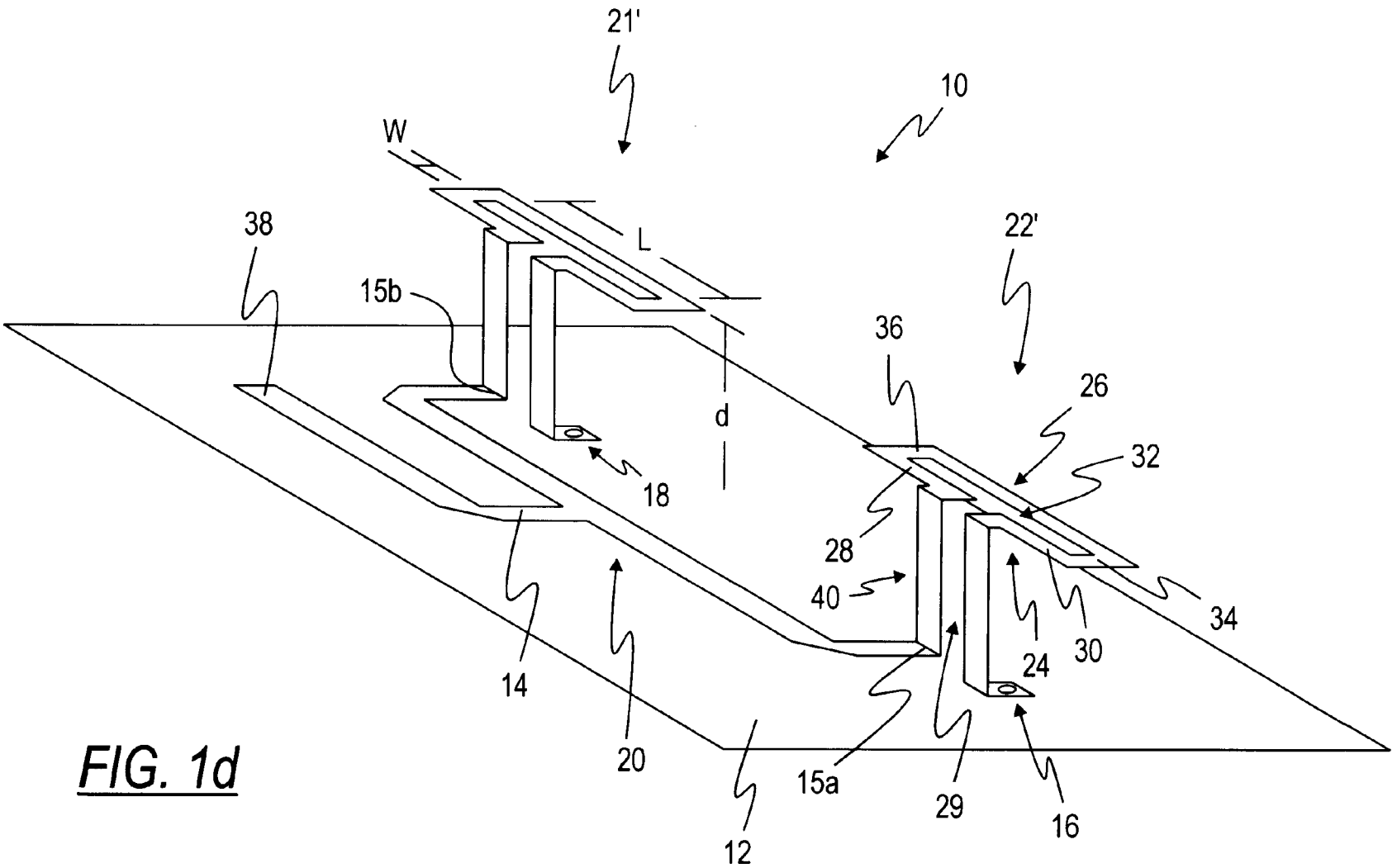
FIG. 1*d* is an isometric view of a folded dipole antenna according to a further embodiment of the present invention.

In another embodiment shown in FIG. 1*d*, the conductor 14 is bent to form radiating sections 21', 22'. In this embodiment, the conductor 14 is bent such that the passive dipoles 26 of each radiating section 21' and 22' are generally perpendicular to the respective conductor sections 40 and are generally parallel to the ground plane 12.

Figure 1E:
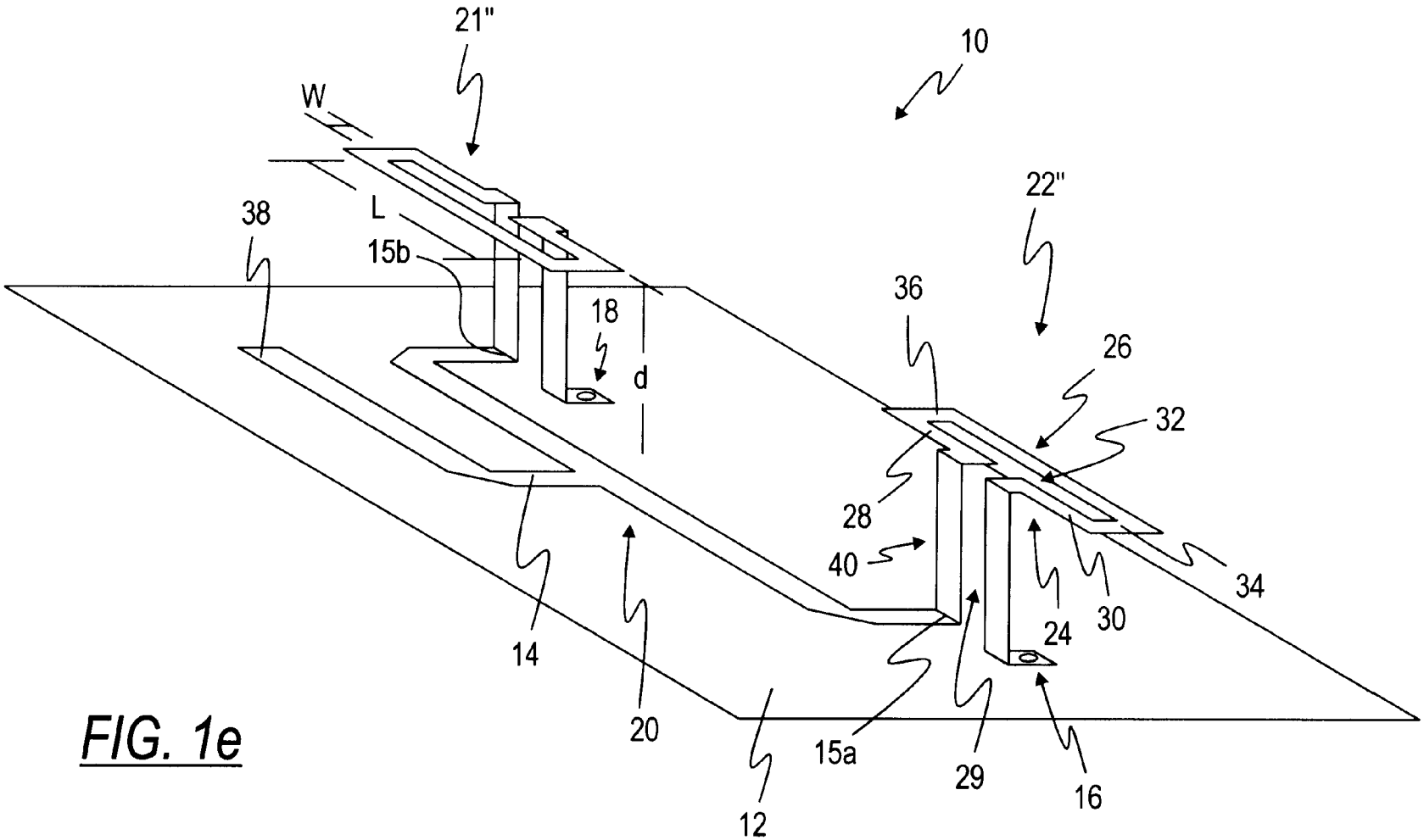
FIG. 1*e* is an isometric view of a folded dipole antenna according to another embodiment of the present invention.

In still another embodiment shown in FIG. 1*e*, radiating sections 21", 22" are bent in opposite directions such that the passive dipoles 26 of each radiating section 21" and 22" are disposed about 180 degrees from each other, are generally perpendicular to the respective conductor sections 40, and are each generally parallel to the ground plane 12.

In the illustrated embodiments, the passive dipole 26 is disposed parallel to and spaced from the fed dipole 24 to form a gap 32. The passive dipole 26 is shorted to the fed dipole 24 at opposing ends 34 and 36 of the gap 32. The gap 32 has a length L and a width W, where the length L, is greater than the width W. In one embodiment where the antenna 10 is used in the UMTS band of frequencies, the gap length L=2.24" and the gap width W=0.20" while the dipole length is 2.64" and the dipole width is 0.60".

Figure 2:
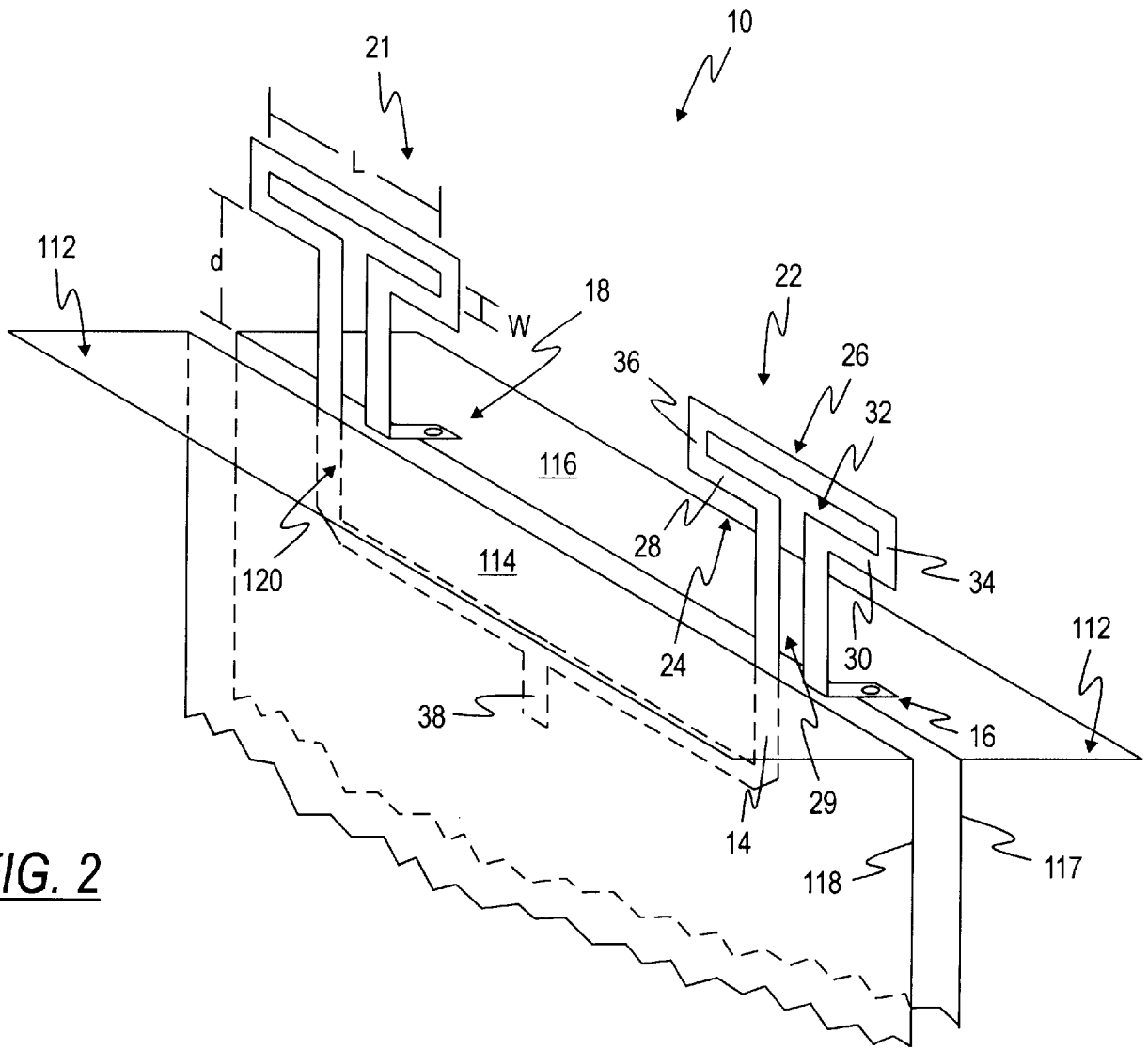
FIG. 2 is an isometric view of a folded dipole antenna according to still another embodiment of the present invention.

Referring to another embodiment shown in FIG. 2, a ground plane 112 is provided which comprises four sections 114, 116, 117, and 118. Sections 114 and 116 are generally co-planar horizontal sections while sections 117 and 118 are generally opposing vertical walls. In this embodiment, the feed section 120 is disposed between the two generally vertical walls 117, 118. The walls 117, 118 of the ground plane 112 are generally parallel to the feed section 120. The feed section 120 and the walls 117, 118 form a triplate microstrip transmission line. The feed section 120 is spaced from the walls 117, 118 by a dielectric such as air, foam, etc. The two sections 114 and 116 are each generally orthogonal to the radiating sections 121, 122. Parts of the antenna of FIG. 2 that are identical to corresponding parts in the antenna of FIG. 1*a* have been identified by the same reference numbers in both figures.

Figure 3:
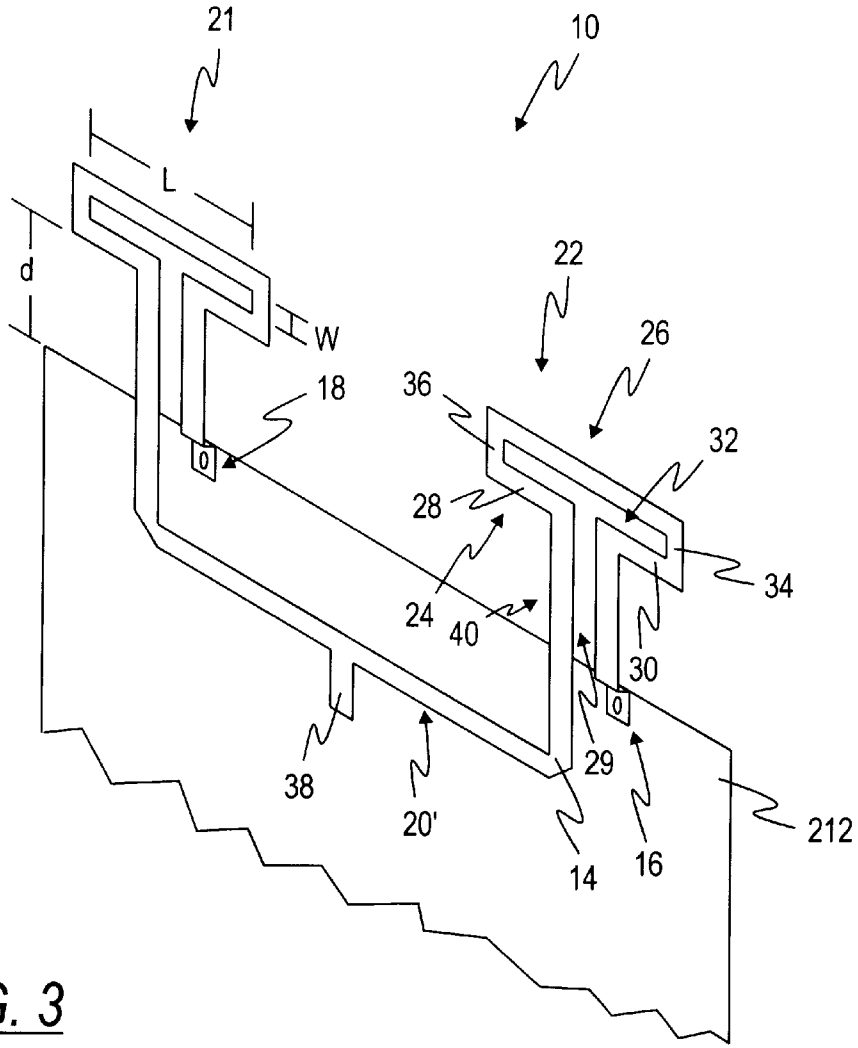
FIG. 3 is an isometric view of a folded dipole antenna according to a further embodiment of the present invention.

In a further embodiment shown in FIG. 3, a single ground plane 212 is provided which is generally vertical. A single feed section 220 and the radiating sections 221, 222 are thus all generally parallel to the ground plane 212. In this embodiment, the fed dipole 24 should be a distance d from the top edge of the ground plane 212 to insure proper transmission and reception. In one embodiment, the distance d=1.22". If the ground plane 212 extends beyond the point where the radiator input section 40 begins, transmission and reception can be impaired. Parts of the antenna of FIG. 3 that are identical to corresponding parts in the antenna of FIG. 1*a* have been identified by the same reference numbers in both figures.

In the embodiments of FIGS. 2 and 3, the conductor 114 or 214 is generally vertical and planar(i e., is not bent along most of its length), although the conductor 114 or 214 shown in FIGS. 2 and 3 is bent slightly for attachment to locations 116, 118 on the ground plane 112, or locations 216, 218 on the ground plane 212. Alternatively, the conductor 114 or 214 could be planar along its entire length, thereby enabling the conductor to be made from a non-bendable dielectric substrate microstrip which is attached directly to the ground planes 112, 212, respectively, by, e.g., bonding.

Figure 4A:
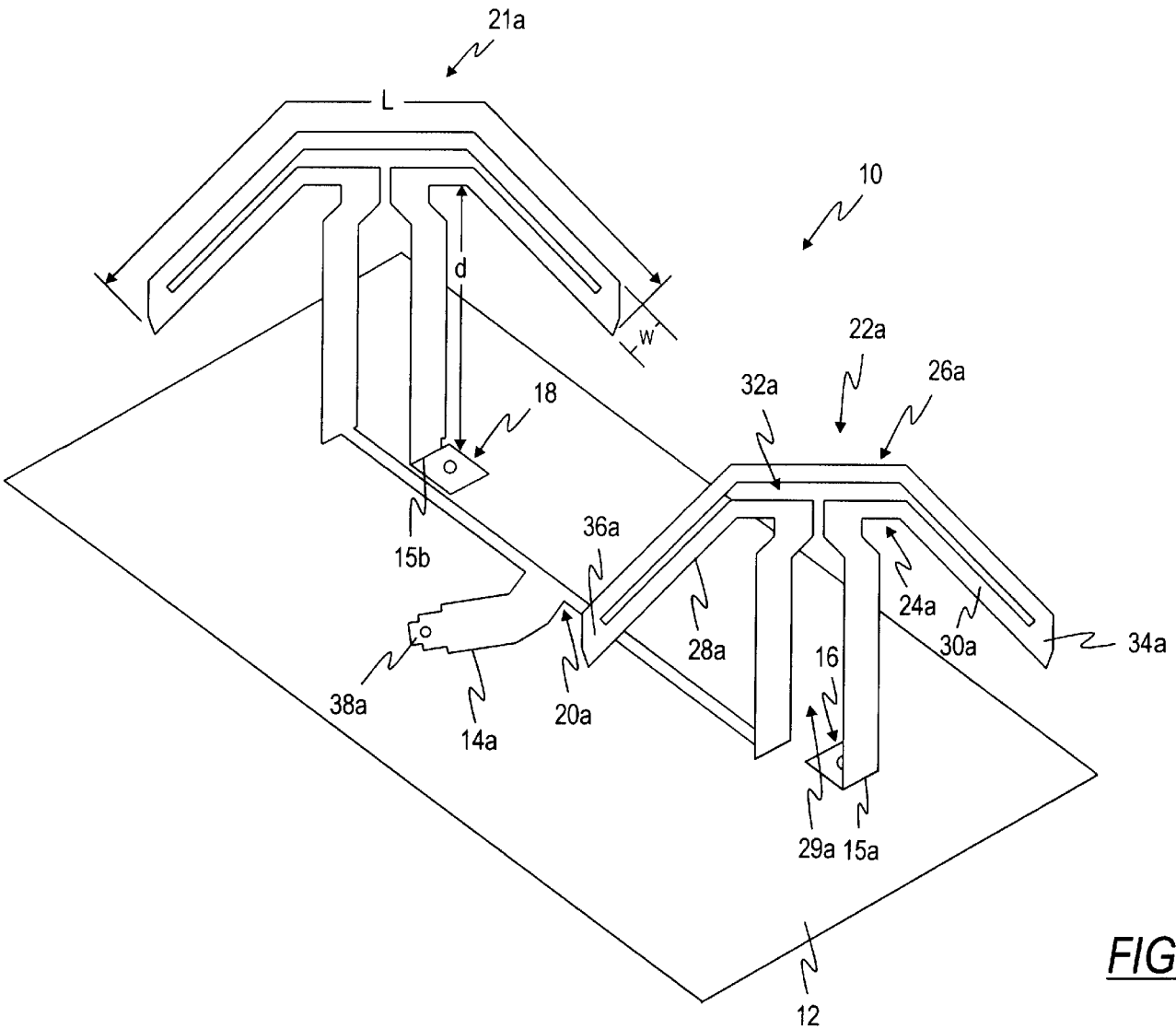
FIG. 4*a* is an isometric view of a folded dipole antenna according to still another embodiment of the present invention.

In another embodiment shown in FIG. 4*a*, radiating sections 321*a*, 322*a* are supported on a ground plane 312 and are generally orthogonal thereto. A conductor 314*a* is bent at bends 315*a* and 315*b* such that the feed section 320*a* is supported by and displaced from the ground plane 312. The ends 334*a*, 336*a* of the radiating sections 321*a*, 322*a* are bent downward towards the ground plane 312. This configuration minimizes the size of the resulting antenna. In addition, bending the radiating sections 321*a*, 322*a* increases the E-plane Half Power Beamwidth (HPBW) of the far-field pattern of the resulting antenna. This embodiment is particularly attractive for producing nearly identical E-plane and H-plane co-polarization patterns in the far-field. In addition, one or more such radiating sections may be used for slant-45 degree radiation, in which the radiating sections are arranged in a vertically disposed row, with each radiating section rotated so as to have its co-polarization at a 45 degree angle with respect to the center axis of the vertical row. In the downwardly bent radiation section embodiment, when patterns are cut in the horizontal plane for the vertical and horizontal polarizations, the patterns will be very similar over a broad range of observation angles.

Figure 4B:
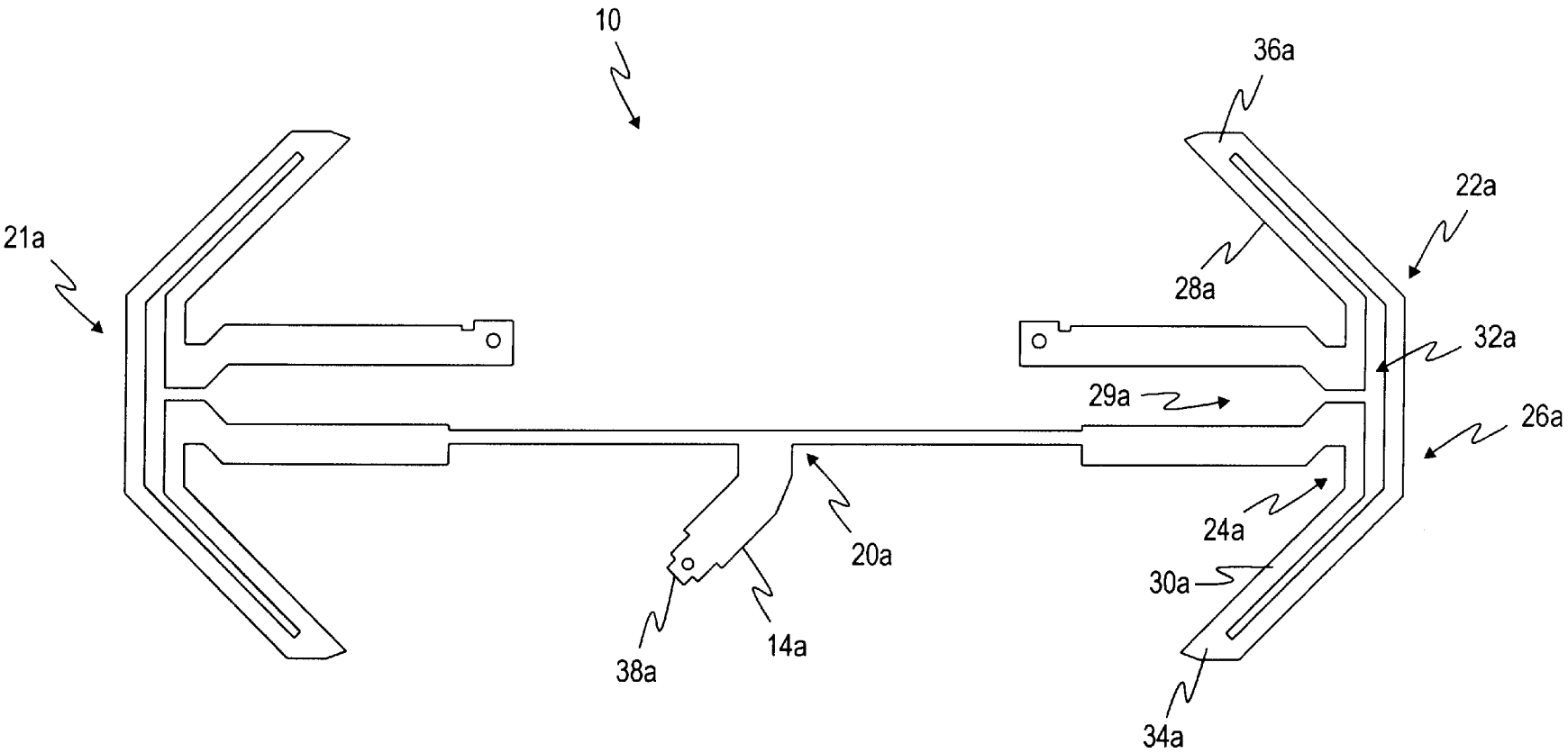
FIG. 4*b* is a top view of a conductor before it is bent into the folded dipole antenna of FIG. 4*a;*

FIG. 4*b* illustrates a top view of the conductor 314*a* before it is bent into the folded dipole antenna of FIG. 4*a*. In the embodiment of FIGS. 4*a* and 4*b*, a passive dipole 326*a* is disposed in spaced relation to a fed dipole 324*a* to form a gap 332*a*. The passive dipole 326*a* is shorted to the fed dipole 324*a* at the ends 334*a* and 336*a*. The gap 332*a* forms a first half-wavelength dipole (passive dipole 326*a*) on one side of the gap 332*a* and a second half-wavelength dipole (fed dipole 324*a*) on the other side of the gap 332*a*. Fed dipole 324*a* includes a centrally-located gap 329*a* which forms the first quarter-wavelength monopole 328*a* and the second quarter-wavelength monopole 330*a*. In one embodiment where the antenna is used in the cellular band of 824–896 MHz and the GSM band of 870–960 MHz, the dipole length L is about 6.52", and the dipole width W is about 0.48". In this embodiment, the innermost section of the fed dipole 324*a* is a distance d from the top of the ground plane 312, where the distance d is about 2.89".

Figure 5A:
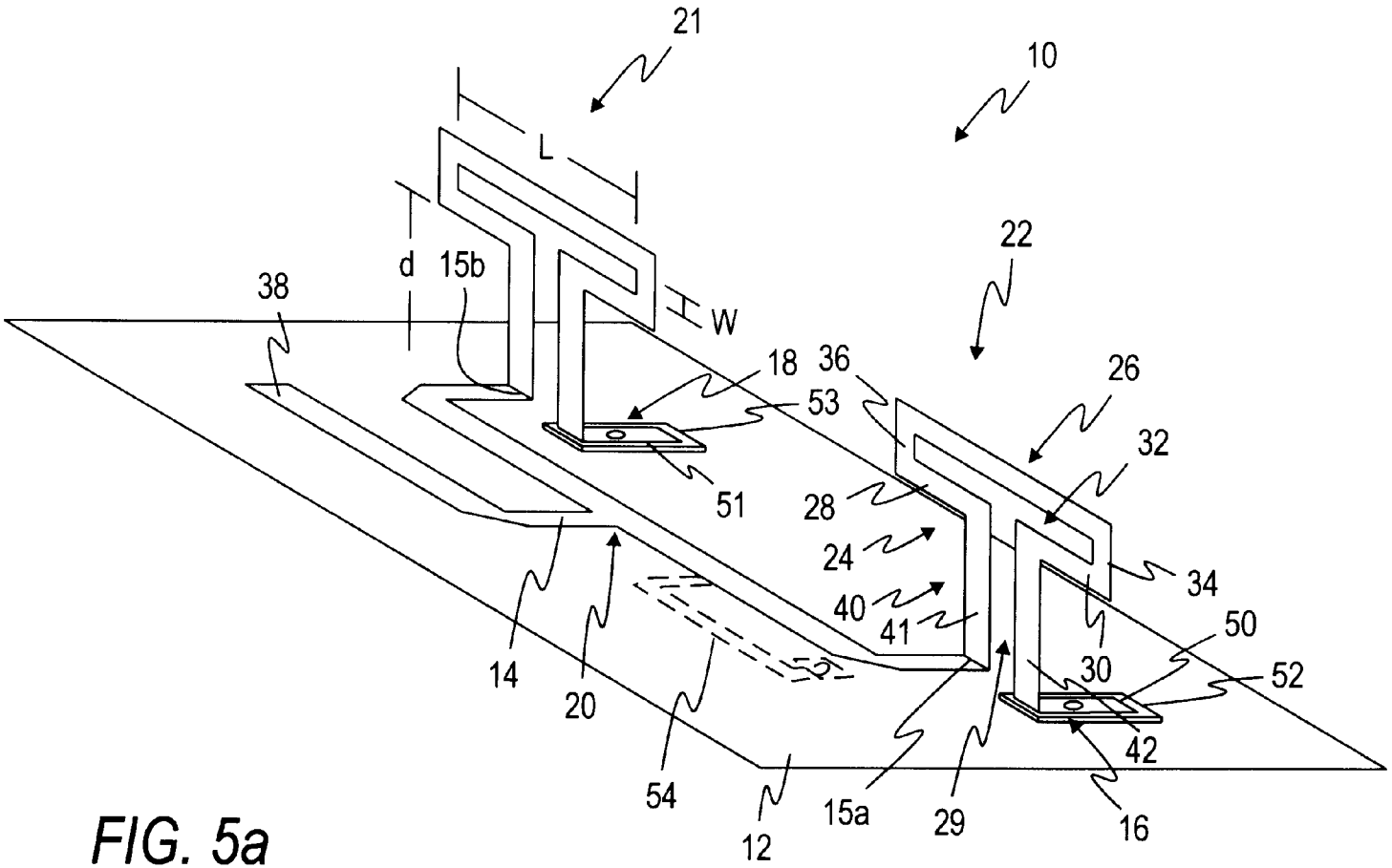
FIG. 5*a* is an isometric view of a folded dipole according to one embodiment of the present invention.
Figure 5B:
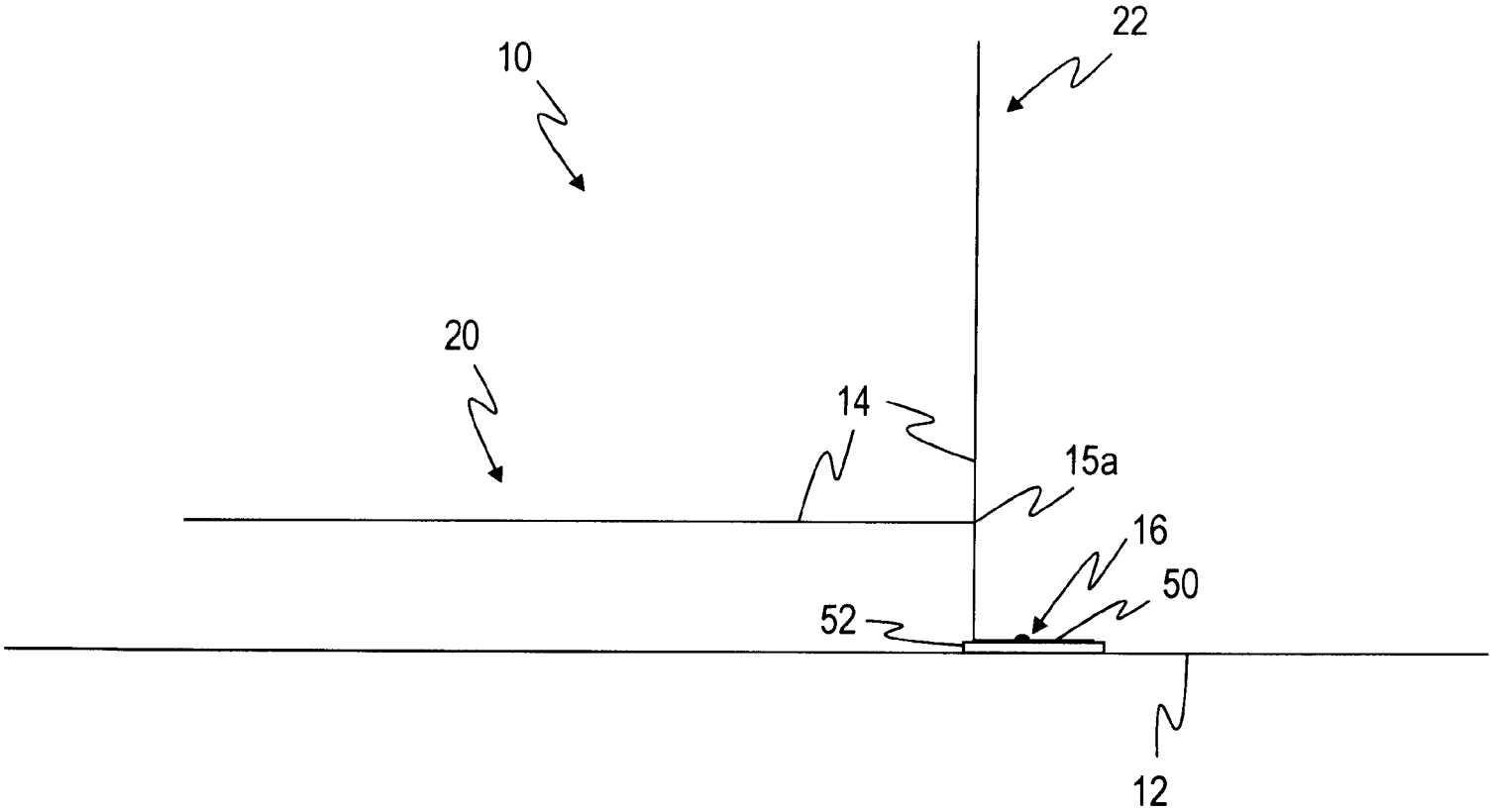
FIG. 5*b* is a side view of the folded dipole antenna of FIG. 5*a;*

In another embodiment illustrated in FIGS. 5*a* and 5*b*, the conductor section 42 terminates in an open-ended transmission line stub 50 that is not electrically connected to the ground plane 12. Rather, the stub 50 is supported above the ground plane 12 by a dielectric spacer 52 which is, for example, bonded to both the stub 50 and the ground plane 12. FIG. 5*b* schematically illustrates a side view of a portion of the antenna 10, including one of the dielectric spacers 52. Alternatively, the stub 50 may be secured to the ground plane 12 by a dielectric fastener that extends through the stub 50 and the ground plane 12 at location 16, as shown in FIGs. 5*a* and 5*b*. The length of the stub 50 is a quarter wavelength at the operating frequency of the antenna. Since the end of the stub 50 forms an open-circuit, there will appear to be an electrical short to ground at the end of the conductor section 42 when the antenna is excited at its operating frequency. This causes the antenna 10 to operate in the same manner as if the conductor section 42 were electrically connected to the ground plane 12. With this arrangement, there are no electrical connections to ground in the radiating element structure. DC grounding for the entire antenna array is provided by electrically connecting one end of a quarter-wavelength shorted transmission line 54 (FIG. 6) to the feed network 20.

The advantage provided by this open-ended-stub embodiment is that the number of electrical connections between the antenna and the ground plane is reduced from one connection per radiating section to one connection per antenna array. This embodiment substantially reduces manufacturing time, reduces the number of parts required for assembly and reduces the cost of the resulting antenna. These advantages are considerable where the antenna 10 contains a large number of radiating sections. The open-ended stub described above may be used in any of the embodiments illustrated in FIGS. 1*a*–4*b*.

Figure 6:
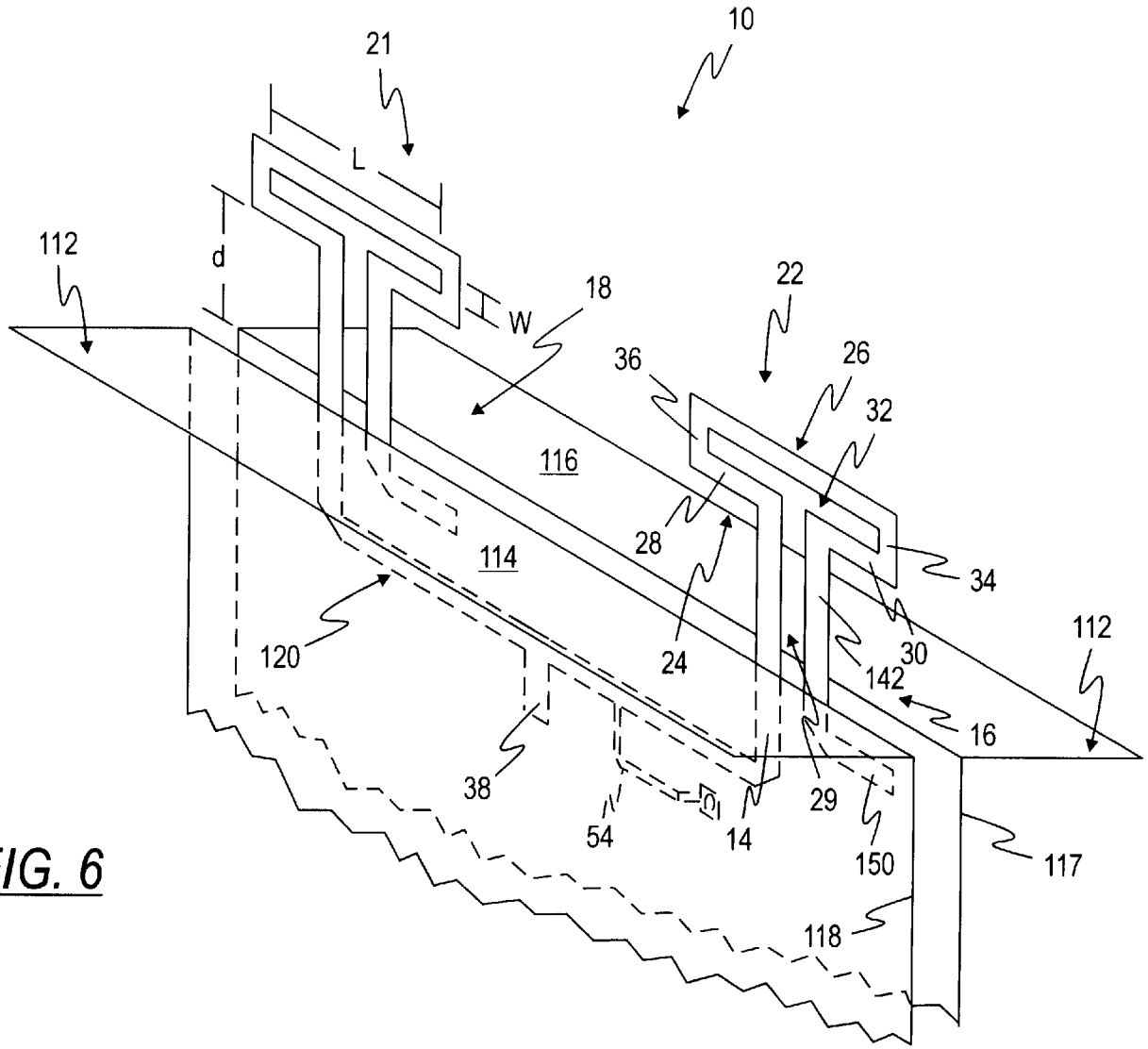
FIG. 6 is an isometric view of a folded dipole antenna according to still another embodiment of the present invention.

FIG. 6 shows still another embodiment similar to FIG. 2 but with the end of a conductor section 142 including an open-ended stripline stub 150. The stub 150 is spaced from the ground plane 112 by dielectric spacers similar to the spacers 52 described above in relation to FIG. 5*a*. As in the case of FIGS. 5*a* and 5*b*, DC grounding for the entire antenna array may be provided by electrically connecting a quarter-wavelength transmission line between the feed section 120 and the ground plane 112.

Figure 7:
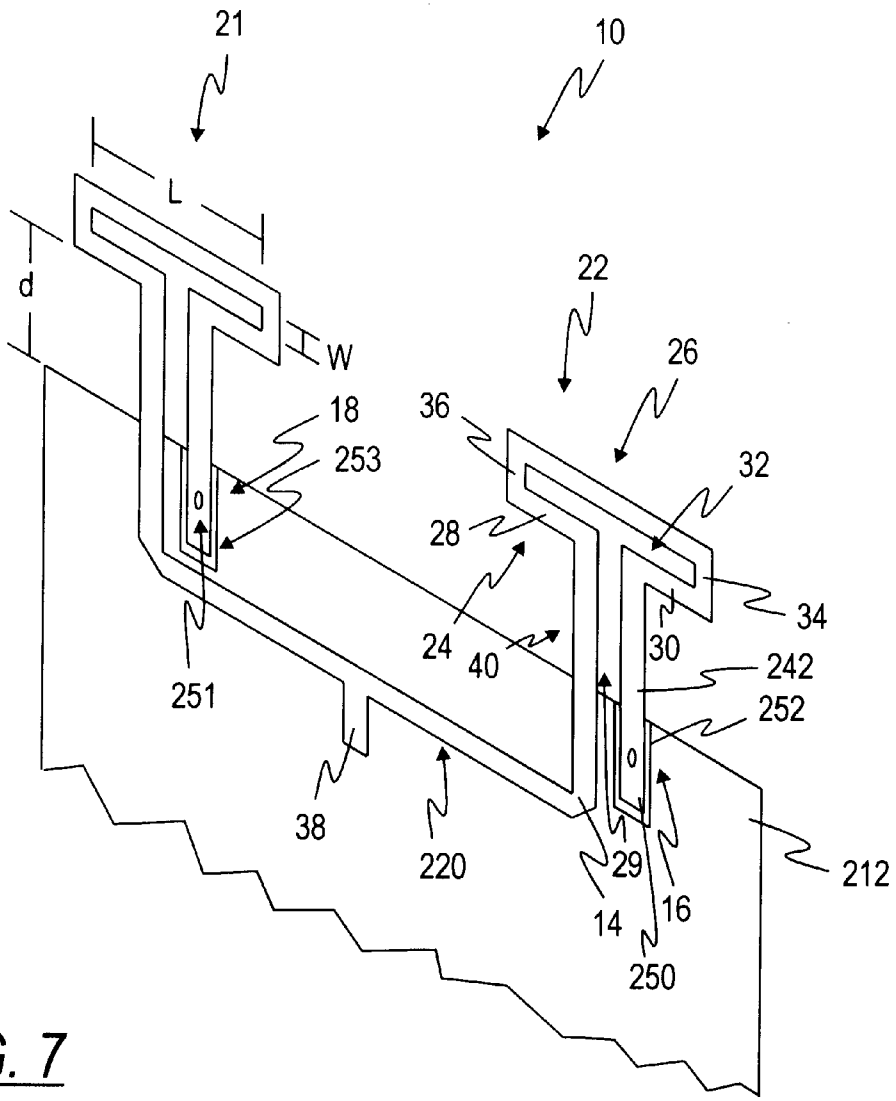
FIG. 7 is an isometric view of a folded dipole antenna according to a further embodiment of the present invention.

FIG. 7 shows another embodiment in which the antenna 10 is supported by dielectric spacers 252. The end of a conductor section 242 includes an open-ended stripline stub 250 spaced from the ground plane 212 by the spacers 252, similar to the spacers 52 described above in relation to FIG. 5*a*. Here again, DC grounding for the entire antenna array may be provided by electrically connecting a quarter-wavelength transmission line between the feed section and the ground plane.

Although the illustrated embodiments show the conductor 14 forming, two radiating sections 21 and 22, the antenna 10 would operate with as few as one radiating section or with multiple radiating sections.

The folded dipole antenna 10 of the present invention provides one or more radiating sections that are integrally formed from the conductor 14. Each radiating section is an integral part of the conductor 14. Thus, there is no need for separate radiating elements (i.e., radiating elements that are not an integral part of the conductor 14) or fasteners to connect the separate radiating elements to the conductor 14 and/or the ground plane 12. The entire conductor 14 of the antenna 10 can be manufactured from a single piece of conductive material such as, for example, a metal sheet comprised of aluminum, copper, brass or alloys thereof. This improves the reliability of the antenna 10, reduces the cost of manufacturing the antenna 10 and increases the rate at which the antenna 10 can be manufactured. The one piece construction of the bendable conductor embodiment is superior to prior antennas using dielectric substrate microstrips because such microstrips can not be bent to create the radiating sections shown, for example, in FIGS. 1*a –e* and 4*a–b*.

Each radiating section, such as the radiating sections 21, 22 in the antenna of FIG. 1*a*, is fed by a pair of conductor sections, such as the conductor sections 41 and 42 in the antenna of FIG. 1*a*, which form a balanced edge-coupled stripline transmission line. Since this transmission line is balanced, it is not necessary to provide a balun. The result is an antenna with very wide impedance bandwidth (e.g., 24%). The impedance bandwidth is calculated by subtracting the highest frequency from the lowest frequency that the antenna can accommodate and dividing by the center frequency of the antenna. In one embodiment, the antenna operates in the PCS, PCN and UMTS frequency bands. Thus, the impedance bandwidth of this embodiment of the antenna is:

$$(2170\ \text{MHz}-1710\ \text{MHz})/1940\ \text{MHz}=24\%$$

Besides having wide impedance bandwidth, the antenna 10 displays a stable far-field pattern across the impedance bandwidth. In the wireless frequency band (1710–2170 MHz) embodiment embodiment, the antenna 10 is a 90 degree azimuthal, half power beam width (HPBW) antenna, i.e., the antenna achieves a 3 dB beamwidth of 90 degrees. To produce an antenna with this HPBW requires a ground plane with sidewalls. The height of the sidewalls is 0.5" and the width between the sidewalls is 6.1". The ground plane in this embodiment is aluminum having a thickness of 0.06". In another wireless frequency band (1710–2170 MHz) embodiment, the antenna 10 is a 65 degree azimuthal HPBW antenna, i.e., the antenna achieves a 3 dB beamwidth of 65 degrees. To produce an antenna with this HPBW also requires a ground plane with sidewalls. The height of the sidewalls is 1.4" and the width between the sidewalls is 6.1". The ground plane in this embodiment is also aluminum having a thickness of 0.06".

The antenna 10 can be integrated into existing single-polarization antennas in order to reduce costs and increase the impedance bandwidth of these existing antennas to cover the cellular, GSM, PCS, PCN, and UMTS frequency bands.

While the present invention has been described with reference to one or more preferred embodiments, those skilled in the art will recognize that many changes may be made thereto without departing from the spirit and scope of the present invention which is set forth in the following claims.

What is claimed is:

1. A folded dipole antenna for transmitting and receiving electromagnetic signals comprising:

a ground plane; and a conductor extending adjacent the ground plane and spaced therefrom by a first dielectric, the conductor including an open-ended transmission line stub, a radiator input section, at least one radiating section integrally formed with the radiator input section, and a feed section;

the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends.

2. The folded dipole antenna of claim 1, wherein the first dielectric is air.

3. The folded dipole antenna of claim 1, wherein the radiating input section is supported adjacent to and insulated from the ground plane by a second dielectric.

4. The folded dipole antenna of claim 3, wherein the second dielectric is a spacer.

5. The folded dipole antenna of claim 3, wherein the second dielectric is a foam.

6. The folded dipole antenna of claim 3, wherein the first and second dielectric are made from the same material.

7. The folded dipole antenna of claim 1, wherein the stub is displaced from the ground plane and insulated therefrom.

8. The folded dipole antenna of claim 1, wherein the antenna has an operating frequency, the length of the stub being a quarter wavelength at the operating frequency.

9. The folded dipole antenna of claim 1, further including a quarter-wavelength transmission line electrically connected between the feed section and the ground plane.

10. The folded dipole antenna of claim 1, wherein the radiator input section includes a first conductor section and a second conductor section separated by a second gap.

11. The folded dipole antenna of claim 10, wherein the first conductor section is supported adjacent the ground plane by a second dielectric.

12. The folded dipole antenna of claim 10, wherein the second conductor section is integral with the feed section.

13. The folded dipole antenna of claim 1, wherein the first and second ends of the radiating section are bent downward towards the ground plane.

14. The folded dipole antenna of claim 1, wherein the passive dipole is disposed parallel to the fed dipole.

15. The folded dipole antenna of claim 1, wherein the radiating section defines a first plane, and the ground plane is generally orthogonal to the plane defined by the radiating section.

16. The folded dipole antenna of claim 1, wherein the radiating section defines a first plane, and the ground plane is generally parallel to the plane defined by the radiating section.

17. The folded dipole antenna of claim 1, wherein the radiating section defines a first plane, and the ,round plane comprises two sections that are each generally orthogonal to the plane defined by the radiating section.

18. The folded dipole antenna of claim 1, wherein the ground plane includes two spaced sections, the feed section extending between the two sections.

19. The folded dipole antenna of claim 1, wherein the ground plane includes four sections, two first sections being located in one plane and two second sections being located in respective parallel planes orthogonal to the one plane, the feed section extending between the two second sections.

20. The folded dipole antenna of claim 1, wherein the ground plane is located in a single plane and the radiating section is generally parallel to the ground plane.

21. The folded dipole antenna of claim 1, wherein the gap has a length and a width, the length being greater than the width.

22. The folded dipole antenna of claim 1, wherein the conductor forms two radiating sections.

23. The folded dipole antenna of claim 1, wherein the conductor includes an RF input section that is adapted to electrically connect to an RF device.

24. The folded dipole antenna of claim 1, wherein the conductor is integrally formed from a sheet of metal.

25. A method of making a folded dipole antenna for transmitting and receiving electromagnetic signals comprising:

providing a ground plane and a conductor including three sections, a feed section, a radiator input section, and at least one radiating section integrally formed with the radiator input section and the feed section, the radiating section including first and second ends, a fed dipole and a passive dipole;

extending the conductor adjacent to the ground plane and spacing the conductor from the ground plane by a first dielectric;

forming a portion of the conductor into an open-ended transmission line stub;

spacing the passive dipole from the fed dipole to form a gap; and shorting the passive dipole to the fed dipole at the first and second ends.

26. The method of claim 25, further including supporting the radiating input section adjacent to and insulating the radiating input section from the ground plane by a second dielectric.

27. The method of claim 26, wherein the radiator input section includes a first conductor section and a second conductor section separated by a second gap and further including supporting the first conductor section adjacent the ground plane by the second dielectric.

28. The method of claim 27, further including integrally forming the second conductor section with the feed section.

29. The method of claim 26, wherein the second dielectric is a spacer.

30. The method of claim 26, wherein the second dielectric is a foam.

31. The folded dipole antenna of claim 26, wherein the first and second dielectric are made from the same material.

32. The method of claim 25, further including displacing the stub from the ground plane and insulating the stub therefrom.

33. The method of claim 25, wherein said antenna has an operating frequency, and further including electrically connecting a transmission line measuring a quarter-wavelength at said operating frequency, between the feed section and the ground plane.

34. The method of claim 25, further including bending the first and second ends of the radiating section downward towards the ground plane.

35. A The method of claim 25, further including integrally forming the conductor from a sheet of metal.

36. The method of claim 25, including interposing a first dielectric between the conductor and the ground plane.

37. The method of claim 25, wherein the antenna has an operating frequency, the length of the shorting stub being a quarter wavelength at the operating frequency.

38. The method of claim 25, including forming the radiator input section as a first conductor section and a second conductor section separated by a second gap.

39. The method of claim 25, including bending the first and second ends of the radiating section downwards towards the ground plane.

40. The method of claim 25, including disposing the passive dipole parallel to the fed dipole.

41. The method of claim 25, including disposing the radiating section in a first plane and disposing the ground plane generally orthogonally to the plane of the radiating section.

42. The method of claim 25, including disposing the radiating section in a first plane and disposing the ground plane generally parallel to the plane of the radiating section.

43. The method of claim 25, including disposing the radiating section in a first plane, and forming the ground plane in two sections, and disposing each of said two sections generally orthogonally to the radiating section.

44. The method of claim 25 including forming the ground plane in two spaced sections, and extending the feed section between the two sections.

45. The method of claim 25, including forming the ground plane as four sections, locating two first sections in one plane and two second sections in parallel planes, and extending the feed section between the two second sections.

46. The method of claim 25, including forming the ground plane in a single plane and disposing the radiating section generally parallel to the ground plane.

47. The method of claim 25, wherein the gap has a length and a width, the length being greater than the width.

48. The method of claim 25, including forming a part of the conductor into two radiating sections.

49. The method of claim 25, including forming a part of the conductor into an RF input section that is adapted to electrically connect to an RF device.

* * * * *